US009506447B2

(12) United States Patent
Ikeda et al.

(10) Patent No.: US 9,506,447 B2
(45) Date of Patent: Nov. 29, 2016

(54) SIGNAL PROCESSING DEVICE

(75) Inventors: Yuji Ikeda, Kobe (JP); Minoru Makita, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 476 days.

(21) Appl. No.: 13/982,576

(22) PCT Filed: Jan. 31, 2012

(86) PCT No.: PCT/JP2012/052171
§ 371 (c)(1),
(2), (4) Date: Oct. 14, 2013

(87) PCT Pub. No.: WO2012/105571
PCT Pub. Date: Aug. 9, 2012

(65) Prior Publication Data

US 2014/0041629 A1 Feb. 13, 2014

(30) Foreign Application Priority Data

Jan. 31, 2011 (JP) ..... 2011-017864

(51) Int. Cl.
*F02P 15/00* (2006.01)
*F02P 7/02* (2006.01)
(Continued)

(52) U.S. Cl.
CPC ..... *F02P 15/00* (2013.01); *F02P 7/02* (2013.01); *F02P 3/0407* (2013.01); *F02P 9/007* (2013.01); *F02P 23/045* (2013.01)

(58) Field of Classification Search
CPC ..... F02B 23/08; F02B 51/04; F02P 1/00; F02P 3/01; F02P 9/002; F02P 9/007; F02P 23/04; F02P 23/045
USPC ..... 123/406.11, 406.26, 406.45, 406.47, 123/143 B, 143 R, 145 R, 594, 606, 642, 536
See application file for complete search history.

(56) References Cited

U.S. PATENT DOCUMENTS 8,226,901 B2 * 7/2012 Makita ..... F02P 3/01 123/143 B
2009/0314239 A1 12/2009 Idogawa et al.
(Continued)

FOREIGN PATENT DOCUMENTS

JP 2009-281188 A 12/2009
JP 2010-1827 A 1/2010
(Continued)

OTHER PUBLICATIONS

International Search Report dated Jul. 31, 2012, issued in corresponding application No. PCT/JP2012/052171.

*Primary Examiner* — John Kwon
*Assistant Examiner* — Johnny H Hoang
(74) *Attorney, Agent, or Firm* — Westerman, Hattori, Daniels & Adrian, LLP

(57) ABSTRACT

An engine control device 13 that cannot output a control signal to an electromagnetic wave emission device 30 is used to emit electromagnetic wave at an appropriate timing from the device 30 to a combustion chamber 10. A signal processing device 40 is connected to the engine control device 13 that outputs an ignition signal for instructing an ignition device 12 of the engine 20 to ignite fuel air mixture in the combustion chamber 10 of the engine 20. The signal processing device 40, upon receiving the ignition signal, outputs to the electromagnetic wave emission device 30 an electromagnetic wave drive signal that determines based on the ignition signal an emission period, which is a period for the electromagnetic wave emission device 30 to emit an electromagnetic wave to the combustion chamber 10, so that an ignition operation is performed during the emission period of the electromagnetic wave.

12 Claims, 8 Drawing Sheets

(51) Int. Cl.

| | |
|---|---|
| *F02P 3/04* | (2006.01) |
| *F02P 9/00* | (2006.01) |
| *F02P 23/04* | (2006.01) |

(56) References Cited

U.S. PATENT DOCUMENTS

| | | | | |
|---|---|---|---|---|
| 2011/0023458 | A1 | 2/2011 | Ikeda | |
| 2011/0025210 | A1* | 2/2011 | Ikeda | F02B 23/08 315/111.21 |
| 2012/0240873 | A1* | 9/2012 | Ikeda | F02B 19/04 123/3 |
| 2014/0014053 | A1* | 1/2014 | Kaneko | F02P 9/007 123/143 B |
| 2014/0224203 | A1* | 8/2014 | Ikeda | F02P 3/01 123/143 B |

FOREIGN PATENT DOCUMENTS

| | | | |
|---|---|---|---|
| JP | 2010-96109 | A | 4/2010 |
| JP | 2010-101179 | A | 5/2010 |
| WO | 2009/008522 | A1 | 1/2009 |
| WO | 2009/113691 | A1 | 9/2009 |

* cited by examiner

SIGNAL PROCESSING DEVICE

TECHNICAL FIELD

The present invention relates to a signal processing device that processes a signal for controlling an engine.

BACKGROUND ART

Conventionally, there is known an engine that emits an electromagnetic wave to a combustion chamber in synchronization with an ignition operation of igniting fuel air mixture in the combustion chamber. For example, Japanese Unexamined Patent Application Publication No. 2009-2219498 discloses an engine of this type.

More particularly, the engine disclosed in Japanese Unexamined Patent Application Publication No. 2009-221948, emits, during a compression stroke, the electromagnetic wave supplied from an electromagnetic wave emission device, from an antenna, while discharging at an electrode of a discharge device. As a result of this, plasma is formed in the vicinity of the electrode due to the discharge, and the plasma is supplied with energy from the electromagnetic wave. In the combustion chamber, a large amount of OH radical and the like is generated by the plasma, and combustion is promoted.

THE DISCLOSURE OF THE INVENTION

Problems to be Solved by the Invention

For the engine, which emits the electromagnetic wave to the combustion chamber in synchronization with the ignition operation of the ignition device, it is required not only to control timings of injecting fuel and performing the ignition operation, but also, to optimize various conditions such as adjustment of an emission period of the electromagnetic wave. Therefore, in a case in which an engine control device (what is called an ECU) alone carries out the control such as described above, it is necessary to newly design the engine control device in view of a control sequence therefor. In general, it consumes much time and labor to newly design the engine control device. Therefore, it requires time and cost more than the conventional engine control device to develop an engine control system which operates in combination with electromagnetic wave energy. Furthermore, since the whole system has to be renewed, it is impossible to apply electromagnetic wave emission device to an engine, which has already penetrated the market.

The present invention has been made in view of the above described circumstances, and it is an object of the present invention to emit an electromagnetic wave from the electromagnetic wave emission device to a combustion chamber of an engine at an appropriate timing, in combination with an engine control device that cannot output a control signal to an electromagnetic wave emission device.

Means for Solving the Problems

In accordance with a first aspect of the present invention, there is provided a signal processing device, which is connected to an engine control device that outputs an ignition signal for instructing an ignition device of an engine to perform an ignition operation of igniting fuel air mixture in a combustion chamber of the engine, and adapted to, upon receiving the ignition signal, output to an electromagnetic wave emission device attached to the engine, an electromagnetic wave drive signal that determines based on the ignition signal an emission period, which is a period for the electromagnetic wave emission device to emit an electromagnetic wave to the combustion chamber, so that the ignition operation is performed during the emission period of the electromagnetic wave.

According to the first aspect of the present invention, the signal processing device is connected to the engine control device. The signal processing device, upon receiving the ignition signal outputted from the engine control device, outputs the electromagnetic wave drive signal to the electromagnetic wave emission device. The electromagnetic wave drive signal determines the emission period of the electromagnetic wave. The emission period of the electromagnetic wave is determined based on the ignition signal so that the ignition operation is performed during the emission period of the electromagnetic wave.

In accordance with a second aspect of the present invention, in addition to the first aspect of the present invention, the ignition signal is a pulse signal, having a falling timing, which serves as a timing of performing the ignition operation, the electromagnetic wave drive signal is a pulse signal having a rising timing and a falling timing, and a period starting from the rising timing thereof until the falling timing serves as a period of driving the electromagnetic wave emission device.

In accordance with a third aspect of the present invention, in addition to the second aspect of the present invention, the signal processing device is connected with the engine control device and the ignition device so that the ignition signal is inputted to the engine control device and the ignition device via the signal processing device, and the signal processing device is adapted to, upon receiving the ignition signal, while delaying the ignition signal and outputting the ignition signal thus delayed to the ignition device, output the electromagnetic wave drive signal that rises at the falling timing of the ignition signal before being delayed.

In accordance with a fourth aspect of the present invention, in addition to the second aspect of the present invention, the signal processing device is connected to the engine control device so that the ignition signal is bifurcated and inputted to the ignition device and the signal processing device, and the signal processing device is adapted to, upon receiving the ignition signal, output the electromagnetic wave drive signal that has a rising timing and a falling timing wherein the rising timing is after the ignition signal rises and before the ignition signal falls, and the falling timing is after the ignition signal falls.

In accordance with a fifth aspect of the present invention, in addition to any one of the second to fourth aspects of the present invention, the signal processing device changes a pulse width of the electromagnetic wave drive signal based on a cycle of the ignition signal.

According to the fifth aspect of the present invention, the pulse width of the electromagnetic wave drive signal is chanced based on the cycle of the ignition signal. The cycle of the ignition signal is indicative of rotation rate of the engine. The pulse width of the electromagnetic wave drive signal is changed based on the cycle of the ignition signal reflecting the rotation rate of the engine.

In accordance with a sixth aspect of the present invention, in addition to any one of the first to fifth aspects of the present invention, the engine includes a plurality of combustion chambers, the ignition devices are attached to the engine, respectively in association with the combustion chambers, the electromagnetic wave emission device includes an electromagnetic wave oscillation device, a plurality of antennae for electromagnetic wave emission respectively corresponding to the plurality of combustion chambers, and a distributor that switches the antenna to be supplied with the electromagnetic wave oscillated by the electromagnetic wave oscillation device, and while the engine control device outputs the ignition signal for each ignition device corresponding to each combustion chamber, the signal processing device is adapted to, upon receiving the ignition signal, output to the distributor a distribution signal for switching a supply destination of the electromagnetic wave to the antenna of the combustion chamber corresponding to the ignition device to which the ignition signal is directed.

In accordance with a seventh aspect of the present invention, there is provided a signal processing device which is connected to an engine control device that outputs an injection signal for instructing a fuel injection device of an engine to inject fuel, and is adapted to, upon receiving the injection signal, output to an electromagnetic wave emission device attached to the engine, an electromagnetic wave drive signal that determines an emission period of an electromagnetic wave based on the injection signal so that the electromagnetic wave emission device emits the electromagnetic we to a combustion chamber while the fuel injection device is injecting the fuel.

According to the seventh aspect of the present invention, the signal processing device is connected to the engine control device. The signal processing device, upon receiving the injection signal outputted from the engine control device, outputs the electromagnetic wave drive signal to the electromagnetic wave emission device. The electromagnetic wave drive signal determines the emission period of the electromagnetic wave. The emission period of the electromagnetic wave is determined based on the injection signal so that the electromagnetic wave is emitted while the fuel is being injected.

Effect of the Invention

According to the first to sixth aspects of the present invention, the emission period of the electromagnetic wave is determined based on the ignition signal so that the ignition operation is performed during the emission period of the electromagnetic wave. The emission period of the electromagnetic wave is appropriately determined based on the ignition signal. Accordingly, using the engine control device that cannot output a control signal to the electromagnetic wave emission device, it is possible to emit the electromagnetic wave at an appropriate timing from the electromagnetic wave emission device to the combustion chamber. Therefore, it is possible to easily develop an engine system incorporating a use of electromagnetic wave energy.

Furthermore, according to the fifth aspect of the present invention, the pulse width of the electromagnetic wave drive signal is changed based on the cycle of the ignition signal reflecting the rotation rate of the engine. Accordingly, it is possible to adjust the pulse with of the electromagnetic wave drive signal in accordance with the rotation rate of the engine.

Furthermore, according to the seventh aspect of the present invent ion, the emission period of the electromagnetic wave is determined based on the injection signal so that the electromagnetic wave is emitted while the fuel is being injected. The emission period of the electromagnetic wave is appropriately determined based on the injection signal. Accordingly, using the engine control device that cannot output a control signal to the electromagnetic wave emission device, it is possible to emit the electromagnetic wave at an appropriate timing from the electromagnetic wave emission device to the combustion chamber. Therefore, it is possible to easily develop an engine system incorporating a use of electromagnetic wave energy.

Furthermore, according to the first to seventh aspects of the present invention, using an engine control device of an engine, which has already penetrated the market as it is, by adding the signal processing device to the engine, it is possible to emit the electromagnetic wave at an appropriate timing from the electromagnetic wave emission device to a combustion chamber of the engine. Therefore, it is possible to easily apply the electromagnetic wave emission device to the engine, which has already penetrated the market.

BEST MODE FOR CARRYING OUT THE INVENTION

In the following, a detailed description will be given of embodiments of the present invention with reference to drawings. It should be noted that the following embodiments are merely preferable examples, and do not limit, the scope of the present invention, applied field thereof, or application thereof.

The present embodiment is directed to an example of a signal processing device 40 according to the present invention. The signal processing device 10 is adapted to process signal for controlling an engine 20. Firstly, the engine 20 will be described hereinafter before the signal processing device 40 is described in detail.

<Engine>

Figure 1:
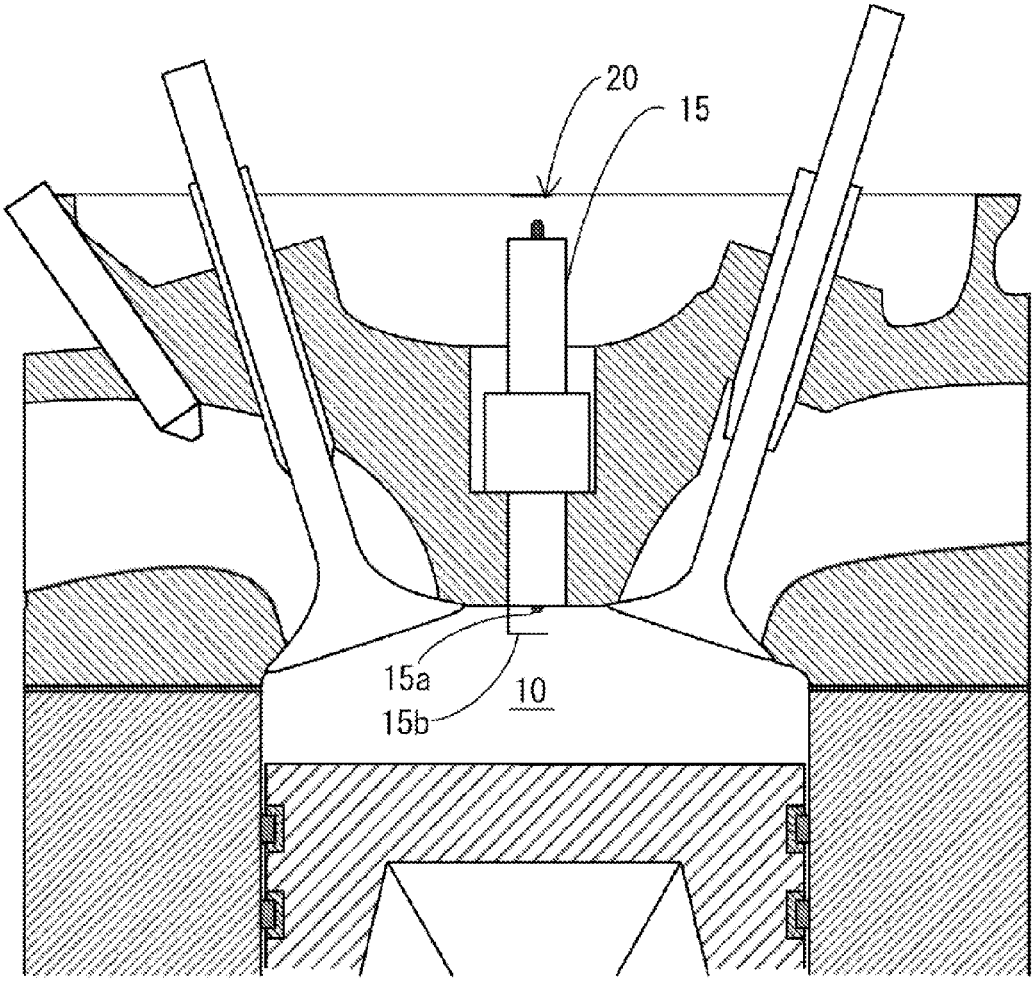
FIG. 1 is a longitudinal cross section view of an engine.

As shown in FIG. 1, the engine 20 is a reciprocating engine. The engine 20 is provided with a plurality of combustion chambers 10, and a plurality of ignition devices 12 respectively corresponding to the combustion chambers 10 are attached to the engine 20. According to the present embodiment, it is assumed that the engine 20 is a four cylinder engine including four combustion chambers 10.

The ignition device 12 is attached to the engine 20 for each combustion chamber 10. The ignition device 12 performs an ignition operation of igniting fuel air mixture in the combustion chamber 10. The ignition device 12 is provided with an ignition coil 11 and an ignition plug 15. In the ignition operation, the ignition coil 11, upon receiving an ignition signal, which will be described later, boosts a voltage applied from a direct current power supply (for example, a battery of a vehicle), and outputs the boosted high voltage pulse. The high voltage pulse is supplied to the ignition plug 15 via a mixer 34, which will be described later. The ignition plug 15, upon receiving the high voltage pulse, causes a spark discharge.

Figure 2:
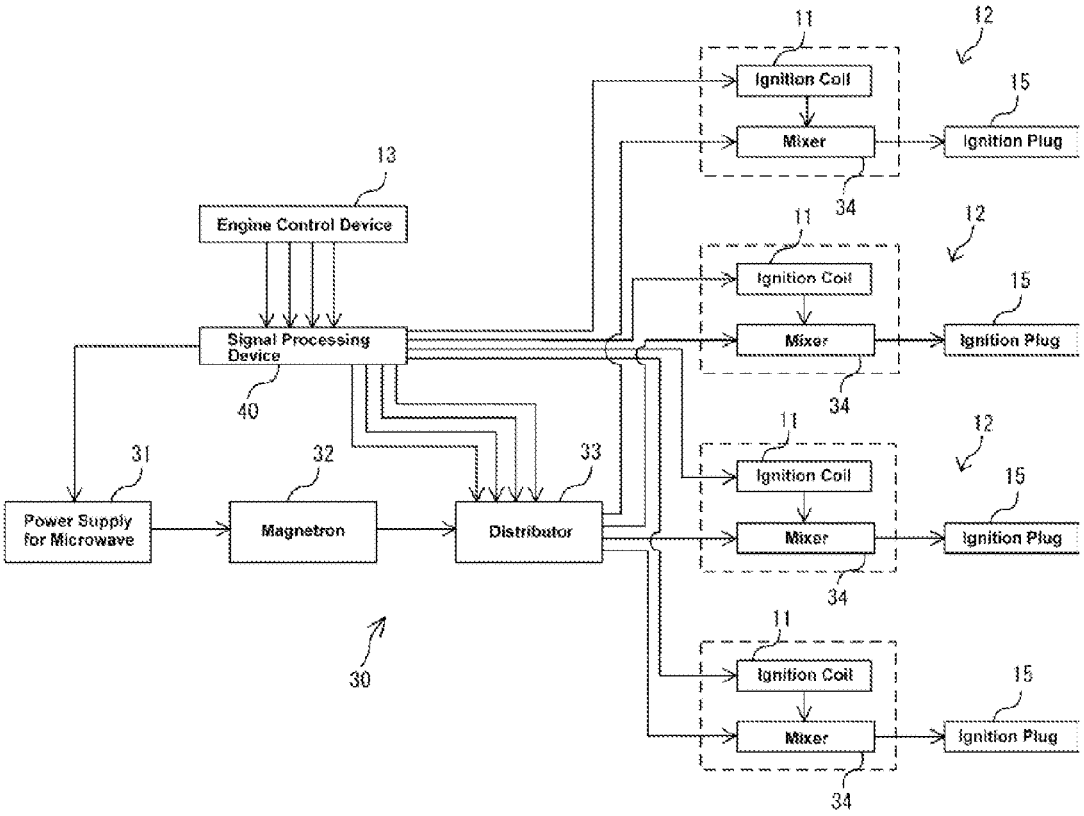
FIG. 2 is a block diagram of an ignition device and an electromagnetic wave emission device according to an embodiment.

An electromagnetic wave emission device 30 is attached to the engine 20, and emits a microwave in each combustion chamber 10 so as to generate non-equilibrium microwave plasma (electromagnetic wave plasma). As shown in FIG. 2, the electromagnetic wave emission device 30 is provided with a power supply for microwave 31, a magnetron 32, a distributor 33, the mixer 34, and an antenna 15*a* for electromagnetic wave emission. More specifically, the electromagnetic wave emission device is provided with one power supply for microwave 31, one magnetron 32, and one distributor 33. The mixer 34 and the antenna 15*a* are provided for each combustion chamber 10. The mixer 34 is integrated with the ignition coil 11. As the antenna 15*a*, a central electrode 15*a* of the ignition plug 15 is employed. The power supply for microwave 31 and the magnetron 32 constitute an electromagnetic wave oscillation device that oscillates an electromagnetic wave. In place of the magnetron 32, other types of oscillators such as a semiconductor oscillator may be employed.

The power supply for microwave 31 is connected to the direct current power supply. The power supply for microwave 31, upon receiving an electromagnetic wave drive signal, which will be described later, outputs a pulse current to the magnetron 32. The magnetron 32, upon receiving the pulse current, outputs a microwave pulse to the distributor 33.

The distributor 33 is a single pole four throw RF (Radio Frequency) switch. The distributor 33, upon receiving a distribution signal, which will be described later, performs a distribution operation of switching a supply destination of the microwave outputted from the magnetron 32 to the antenna 15*a* of the combustion chamber 10 determined in accordance with the distribution signal. The distributor 33 outputs the microwave outputted from the magnetron 32 via the mixer 34 to one of the antennae 15*a*.

The mixer 34 mixes the high voltage pulse outputted from the ignition coil 11 and the microwave pulse outputted from the magnetron 32 and outputs them to the ignition plug 15. The ignition plug 15, when supplied with the high voltage pulse and the microwave use at the central electrode 15*a*, causes the spark discharge at a discharge gap between the central electrode 15*a* and a ground electrode 15*b*, and irradiates discharge plasma generated by the spark discharge with the microwave from the central electrode 15*a*. The discharge plasma generated by the spark discharge absorbs energy of the microwave and expands. The electromagnetic wave emission device 30 generates microwave plasma by supplying the combustion chamber 10 with the microwave in synchronization with the ignition operation of the ignition device 12.

<Signal Processing Device>

The signal processing device 40 is a device that processes the ignition signal outputted from an engine control device 13 (what is called ECU) that controls the engine 20 in accordance with a load and rotation rate of the engine 20. The signal processing device 40 is mounted separately from the engine control device 13, and electrically connected to the engine control device 13, the ignition device 12, and the electromagnetic wave emission device 30.

The engine control device 13 outputs an ignition signal to the ignition device 12, wherein the instruction signal is indicative of instructing the ignition device 12 to perform the ignition operation at a timing of ignition in the combustion chamber 10 to which the ignition device 12 is attached. The engine control device 13 outputs an ignition signal corresponding to each ignition device 12 from an output terminal corresponding to each ignition device 12. The ignition signal is a pulse signal of a predetermined pulse width.

Figure 3:
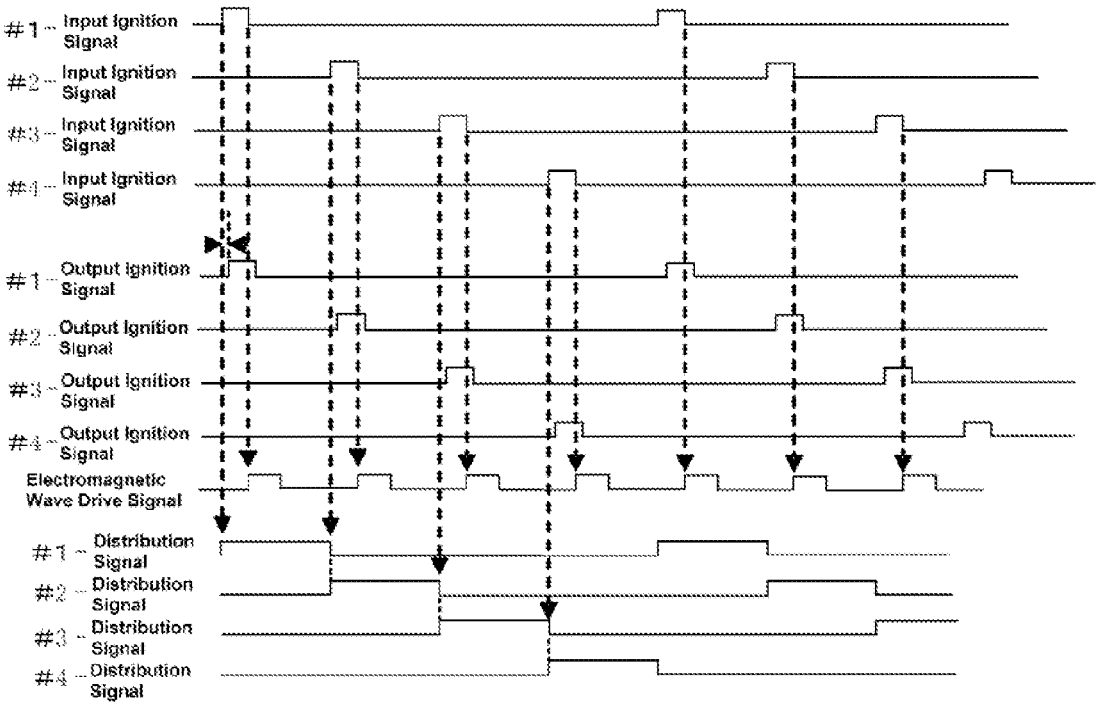
FIG. 3 is a time chart of control signals of a signal processing device according to the embodiment.

The signal processing device 40 receives the ignition signal corresponding to each ignition device 12 from an input terminal corresponding to each ignition device 12. As shown in FIG. 3, the signal processing device 40 delays the received ignition signal by a short period of time, and outputs it to the ignition coil 11 of each ignition device 12 from an output terminal provided corresponding to each ignition device 12. The ignition signal is inputted to the ignition coil 11 via the signal processing device 40. Hereinafter, the ignition signal before being delayed is referred to as an "input ignition signal", and the delayed ignition signal is referred to as an "output ignition signal".

The output ignition signal is outputted by the time when the input ignition signal falls. This means that a delay time by which the input ignition signal is delayed is shorter than a pulse width of the ignition signal.

In the ignition coil 11, from a rising timing of the output ignition signal, a current starts to flow on a primary side of a transformer, and, at a falling timing of the output ignition signal, the high voltage pulse is outputted to the ignition plug 15 from a secondary side of the transformer. Then, the spark discharge is caused at the ignition plug 15. In this manner, the ignition device 12, upon receiving the output ignition signal, performs the ignition operation. The falling timing of the output ignition signal serves as a timing of performing the ignition operation. The timing of performing the ignition operation is delayed from a falling timing of the input ignition signal by the delay time.

The signal processing device 40, at a rising timing of the input ignition signal, outputs to the distributor 33 the distribution signal for switching the supply destination of the microwave to the antenna 15*a* of the combustion chamber 10 corresponding to the ignition device 12 to which the ignition signal is directed, and, at the fall timing of the input ignition signal, outputs the electromagnetic wave drive signal to the power supply for microwave 31 of the electromagnetic wave emission device 30. The electromagnetic wave drive signal is a pulse signal.

The distributor 33, upon receiving the distribution signal, switches the supply destination of the microwave to the antenna 15*a* of the combustion chamber 10 corresponding to the ignition device 12 to which the ignition signal is directed. On the other hand, the power supply for microwave 31, upon receiving the electromagnetic wave drive signal, outputs the pulse current to the magnetron 32 at a predetermined duty cycle from the rising timing of the electromagnetic wave drive signal up to the falling timing thereof. The magnetron 32, upon receiving the pulse current, outputs the microwave pulse. Since the distributor 33 has already performed the switching before the microwave pulse oscillation, the microwave pulse oscillated from the magnetron 32 is supplied to the antenna 15*a* of the combustion chamber 10 corresponding to the ignition device 12 to which the ignition signal is directed. A period from the rising timing of the electromagnetic wave drive signal up to the falling timing thereof serves as a period to drive the electromagnetic wave emission device 30.

According to the present embodiment, as described above, the timing of performing the ignition operation is delayed from the falling timing of the input ignition signal by the delay time. A timing of starting radiation of the microwave is the falling timing of the input ignition signal, and a timing of terminating radiation of the microwave is after the fall of the output ignition signal. Therefore, in each combustion chamber 10, the ignition operation is performed during an emission period in which the electromagnetic wave emission device 30 emits the microwave to the combustion chamber 10.

The delay time of the ignition signal is a period of time that does not influence a timing of combustion in the combustion chamber 10. This means that the delay time is configured in view of a period of delay from when the magnetron 32 receives the pulse current until when the microwave oscillation starts. The delay time may be, for example, 100 μs or so.

Figure 4:
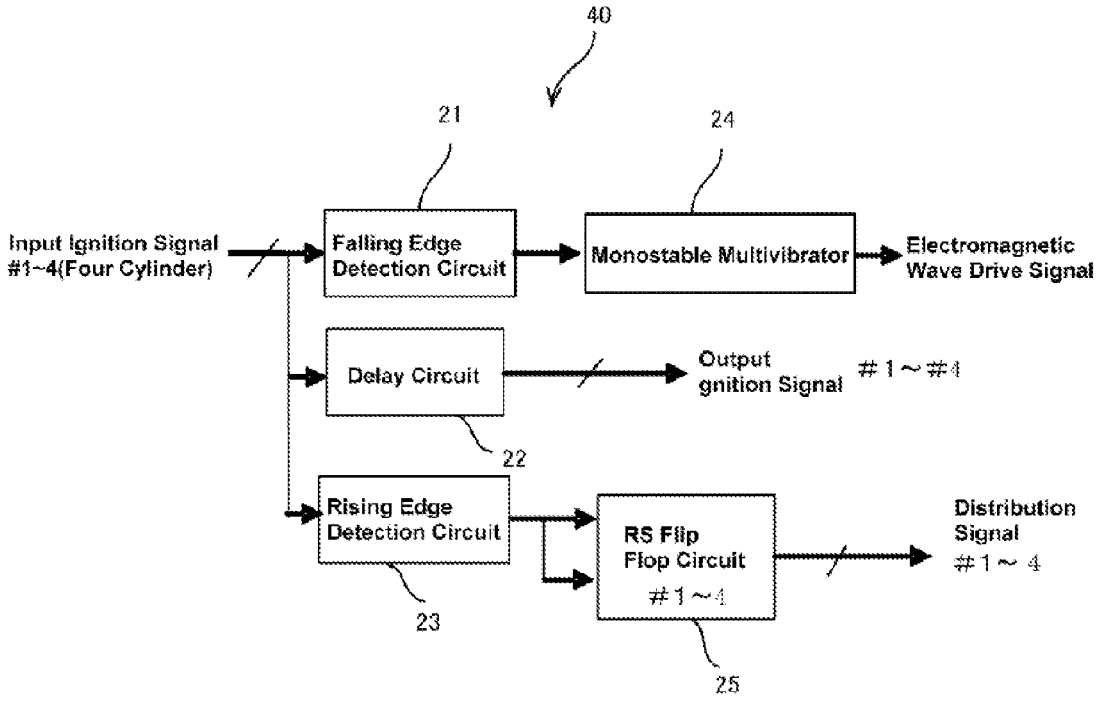
FIG. 4 is a block diagram of the signal processing device according to the embodiment.
Figure 5:
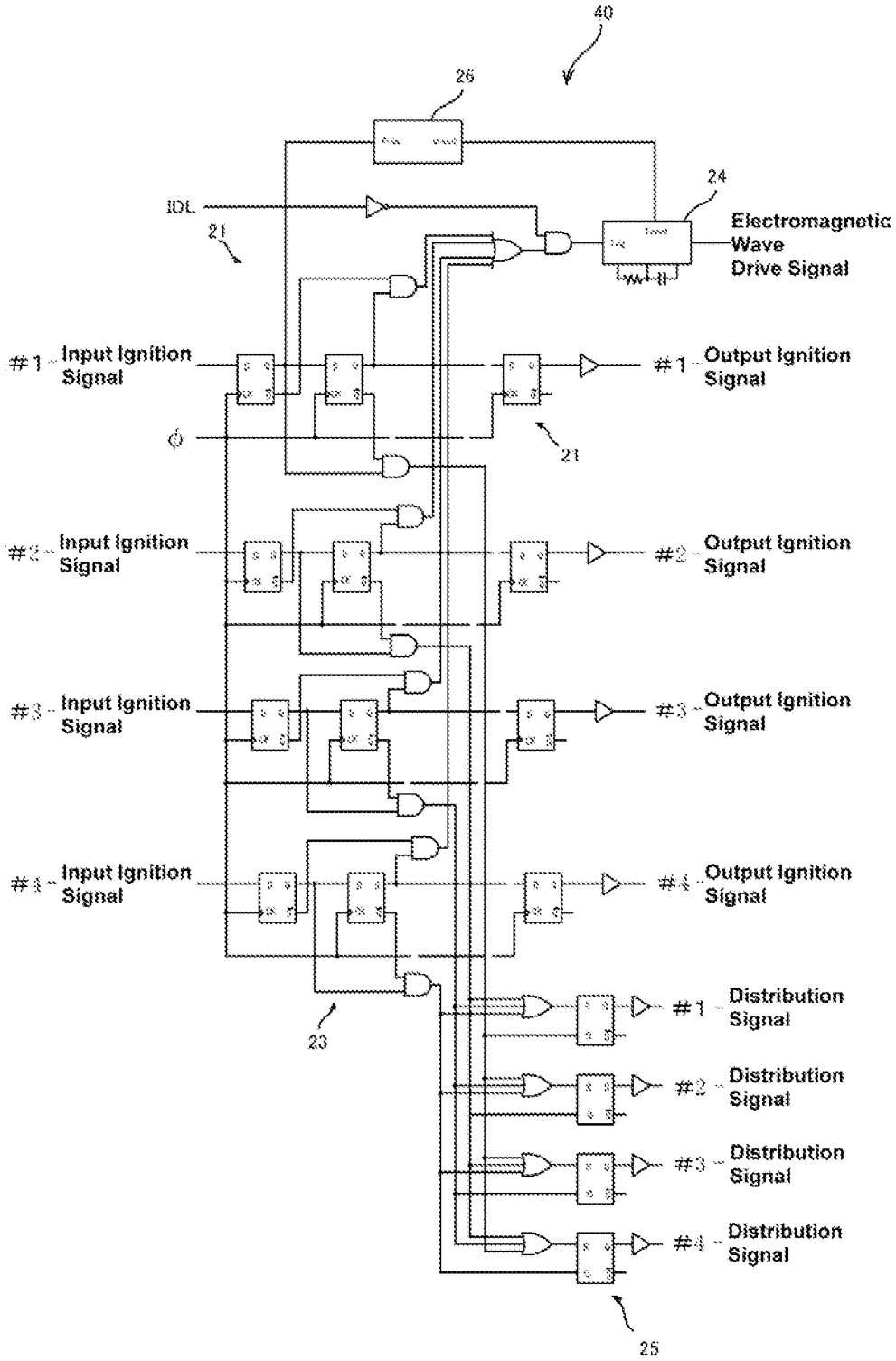
FIG. 5 is a logic circuit of the signal processing device according to the embodiment.

FIG. 4 shows a block diagram of the signal processing device 40. FIG. 5 shows an example of logic circuit of the signal processing device 40. In FIGS. 3, 4, and 5, cylinder numbers are designated by numerals. #1 to #4. The ignition signal has a positive logic.

In the signal processing device 40, as shown in FIG. 4, the ignition signal is inputted to a falling edge detection circuit 21, a delay circuit 22, and a rising edge detection circuit 23.

In the delay circuit 22, the ignition signal is delayed by means of an n-stage shift register constituted by D-flip flops. The delay time is n×ϕ wherein ϕ represents a clock cycle.

The falling edge detection circuit 21 detects a fall of the input ignition signal utilizing a time gap based on clock synchronization between adjacent D-flip flops connected in series. The detection signals of the falls of the input ignition signals are summed up, and used as a trigger signal to trigger a monostable multivibrator 24 to generate pulses. The generated pulses are outputted as the electromagnetic wave drive signal from the monostable multivibrator 24.

The rising edge detection circuit 23 detects a rise of the input ignition signal utilizing a time gap based on clock synchronization between adjacent D-flip flops connected in series. The detection signal of the rise of the input ignition signal is transferred as a set signal to an RS flip flop of a cylinder corresponding to the input ignition signal, from among the RS flip flops #1 to #4 respectively corresponding to the cylinders #1 to #4, and transferred as reset signals to the RS flip flops of the rest of cylinders. As a result of this, from among the RS flip flops #1 to #4, only one RS flip flop, which corresponds to the cylinder to be subject to ignition control, is set. The outputs from the RS flip flops #1 to #4 are employed as the distribution signals for distributing the microwave.

IDL is intended to mean an idling signal, which blocks the trigger signal from being inputted to the monostable multivibrator 24 during idling. An FV (Frequency Voltage) converter 25 generates a level signal in accordance with a cycle of the input ignition signal. A width of the pulse generated by the monostable multivibrator 24 is modulated in accordance with the generated level signal. As a result of this, a pulse width of the electromagnetic wave drive signal is changed based on the cycle or the input ignition signal. Therefore, it is possible to change the pulse width of the electromagnetic wave drive signal in accordance with a rotation rate of the engine 20. For example, the pulse width of the electromagnetic wave drive signal may be reduced in inverse proportion to the increase in rotation rate of the engine 20. Alternatively, the pulse width of the electromagnetic wave drive signal may be set to a predetermined constant value.

Effect of Embodiment

According to the present embodiment, the emission period of the microwave is determined based on the ignition signal so that the ignition operation is performed during the emission period of the microwave. The emission period of the microwave is properly determined based on the ignition signal. Accordingly, using the engine control device 13 that cannot output a control signal to the electromagnetic wave emission device 30, it is possible to emit the microwave from the electromagnetic wave emission device 30 to the combustion chamber 10 at an appropriate timing. Therefore, it is possible to easily develop an engine system operable in combination with microwave energy.

Furthermore, according to the present embodiment, the pulse width of the electromagnetic wave drive signal is changeable based on the cycle of the ignition signal, which reflects the rotation rate of the engine 20. Therefore, it is possible to adjust the pulse width of the electromagnetic wave drive signal in accordance with the rotation rate of the engine 20.

Furthermore, according to the present embodiment, by adding the signal processing device 40 to an engine, which has already penetrated the market while, on the other hand, employing the conventional engine control device 13 as it is, it is possible to emit the microwave from the electromagnetic wave emission device 30 to the combustion chamber 10 at an appropriate timing. Therefore, it is possible to easily apply the electromagnetic wave emission device 30 to an engine, which has already penetrated the market.

First Modified Example of Embodiment

Figure 6:
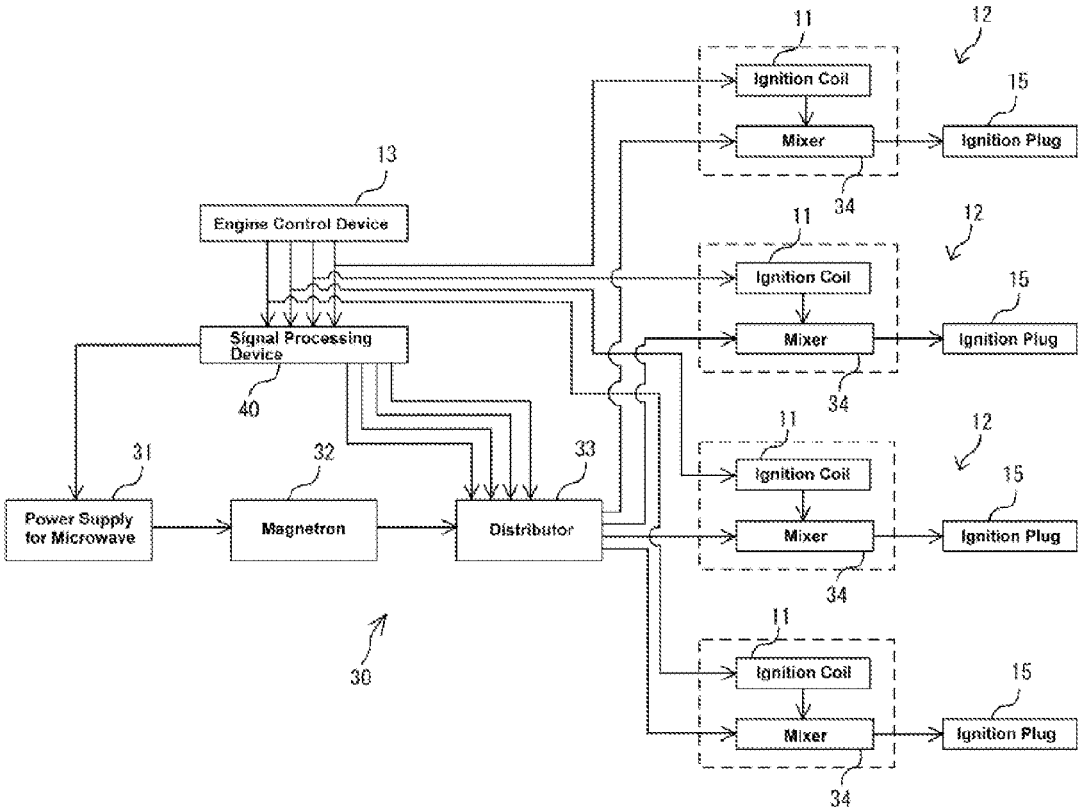
FIG. 6 is a block diagram of an ignition device and an electromagnetic wave emission device according to a first modified example of the embodiment.

According to a first modified example, as shown in FIG. 6, the signal processing device 40 is connected to the engine control device 13, and the ignition signal is bifurcated so as to be inputted to the ignition device 12 and the signal processing device 40. The ignition signal is inputted to each ignition device 12 without being processed by the signal processing device 40.

Figure 7:
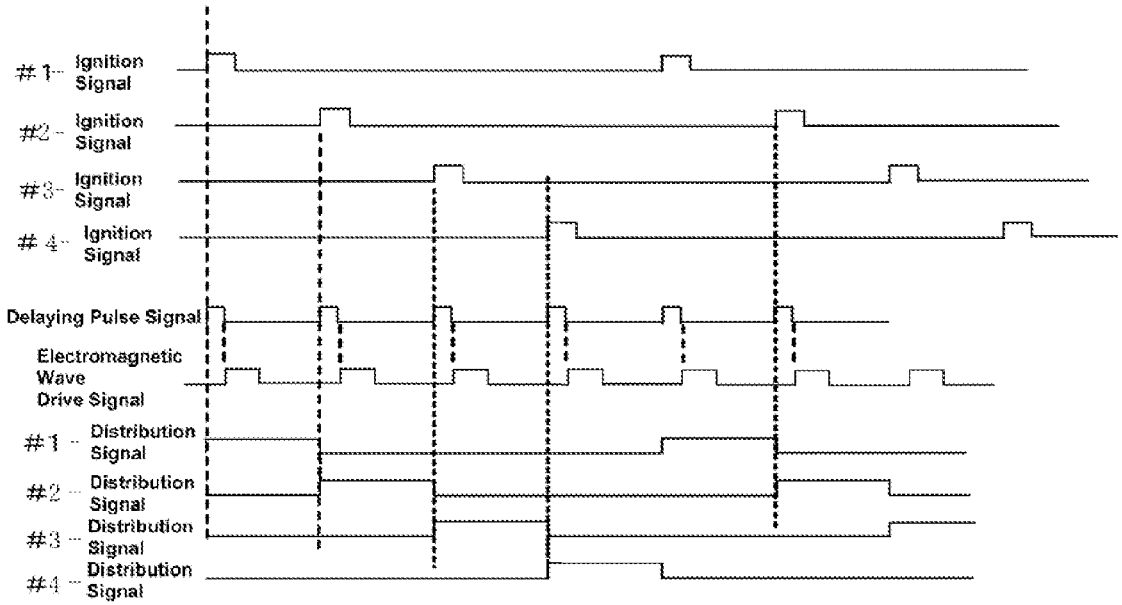
FIG. 7 is a time chart of control signals of a signal processing device according to the first modified example of the embodiment.
Figure 8:
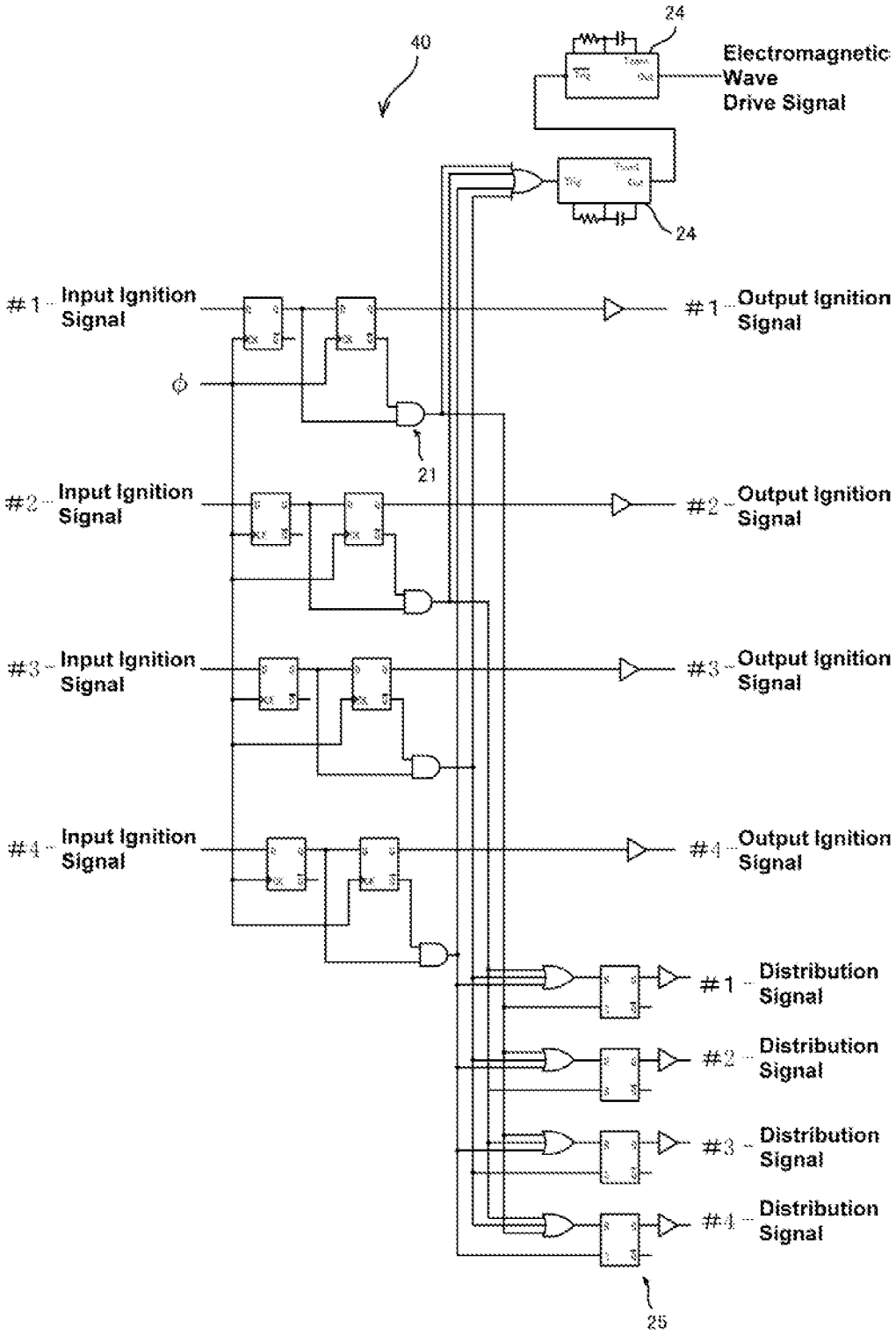
FIG. 8 is a logic circuit of the signal processing device according to the first modified example of the embodiment.

FIG. 7 shows a timing chart of control signals of the signal processing device 40. FIG. 8 shows an example of logic circuit of the signal processing device 40. In FIGS. 7 and 8, cylinder numbers are designated by numerals #1 to #4.

As shown in FIG. 7, the signal processing device 40, upon receiving the ignition signal, outputs the electromagnetic wave drive signal that has a rising timing and a falling timing wherein the rising timing is after the ignition signal rises and before the ignition signal falls, and the falling timing is after the ignition signal falls.

More particularly, as shown in FIG. 7, the signal processing device 40 generates a pulse signal (referred to as "delaying pulse signal") of a predetermined pulse width in synchronization with the rise of the ignition signal. The delaying pulse signal is shorter in pulse width than the ignition signal. The signal processing device 40 generates a control pulse signal of the microwave, which is outputted as the electromagnetic wave drive signal, in synchronization with a fall of the delaying pulse signal.

Furthermore, similarly to the embodiment described above, the signal processing device 40 outputs to the distributor 33, at the rising timing of the ignition signal, the distribution signal for switching the supply destination of the microwave to the antenna 15*a* of the combustion chamber 10 corresponding to the ignition device 12 to which the ignition signal is directed. The signal processing device 40 sets or resets four RS flip flops, shown in FIG. 8, in synchronization with the rising timing of the ignition signals respectively corresponding to the cylinders. The outputs of the RS flip flops serve as the distribution signals for distributing the microwave.

Second Modified Example of Embodiment

In a second modified example, a signal processing device 40 is adapted to process an injection signal outputted to a fuel injection device (not shown) that directly injects fuel to the combustion chamber 10.

The signal processing device 40 is connected to the engine control device 13 that outputs the injection signal for instructing the fuel injection device to inject fuel. The injection signal is inputted to the signal processing device 40. The signal processing device 40, upon receiving the injection signal, outputs to the electromagnetic wave emission device 30 the electromagnetic wave drive signal, which determines the emission period of the microwave based on the injection signal, so that the electromagnetic wave emission device 30 attached to the engine 20 emits the microwave to the combustion chamber 10 while the fuel injection device is injecting fuel. For example, the signal processing device 40 outputs the electromagnetic wave drive signal at the same rising timing as the injection signal. As a result of this, microwave plasma is generated at the same time when the fuel is injected from the fuel injection device. Here, the microwave plasma is generated so as to contact with the injected fuel.

According to the second modified example, the emission period of the microwave is determined based on the injection signal so that the microwave is emitted while the fuel is being injected. The emission period of the microwave is appropriately determined based on the injection signal. Accordingly, using the engine control device 13 that cannot output a control signal to the electromagnetic wave emission device 30, it is possible to emit the microwave at an appropriate timing from the electromagnetic wave emission device 30 to the combustion chamber 10. Therefore, it is possible to easily develop an engine system operable in combination with the microwave energy.

Other Embodiments

The above described embodiment may also be configured as follows.

According to the embodiment described above, the high voltage pulse and the electromagnetic wave may be applied to separate places different from each other. In this case, an antenna for electromagnetic wave emission is provided separately from the central electrode 15*a* of the ignition plug 15. The mixer 34 is not required. The ignition coil 11 is directly connected to the ignition plug 15, and the electromagnetic wave oscillation device is directly connected to the antenna for electromagnetic wave emission. The antenna for electromagnetic wave emission may be internally integrated with the ignition plug 15, and may be provided on a cylinder head separately from the ignition plug 15.

Furthermore, according to the embodiment described above, the ignition device 12 may be configured so as to ignite fuel air mixture by way of laser. Furthermore, the ignition device 12 may be a glow plug.

Furthermore, in the embodiment described above, the ignition operation may be any operation as long as the ignition operation can eventually cause the ignition. In this case, the discharge at the ignition plug 15 is a discharge with energy less than a minimum ignition energy, and fuel air mixture is ignited by the microwave plasma.

INDUSTRIAL APPLICABILITY

The present invention is useful in relation to a signal processing device that processes a signal for controlling an engine.

EXPLANATION OF REFERENCE NUMERALS

10 Combustion Chamber
12 Ignition Device
13 Engine Control Device
20 Engine
30 Electromagnetic Wave Emission Device
40 Signal Processing Device

What is claimed is:

1. A signal processing device, which is connected to an engine control device that outputs an ignition signal which defines a timing for an ignition device of an engine to ignite a fuel air mixture in a combustion chamber of the engine, the signal processing device being configured to, upon receiving the ignition signal, output an electromagnetic wave drive signal to an electromagnetic wave emission device attached to the engine, the electromagnetic wave drive signal defining an emission period of an electromagnetic wave, which is a period for the electromagnetic wave emission device to emit the electromagnetic wave to the combustion chamber, wherein the emission period of the electromagnetic wave is determined based on the timing for the ignition device to ignite the fuel air mixture such that the ignition operation is performed during the emission period of the electromagnetic wave.

2. The signal processing device according to claim 1, wherein the ignition signal is a pulse signal having a falling timing, which serves as a timing of performing the ignition operation, the electromagnetic wave drive signal is a pulse signal having a rising timing and a falling timing, and a period starting from the rising timing thereof until the falling timing serves as a period of driving the electromagnetic wave emission device.

3. The signal processing device according to claim 2, wherein the signal processing device is connected with the engine control device and the ignition device so that the ignition signal is inputted to the engine control device and the ignition device via the signal processing device, and the signal processing device is configured to, upon receiving the ignition signal, output the electromagnetic wave drive signal that rises at the falling timing of the ignition signal before being delayed, while delaying the ignition signal and outputting the ignition signal thus delayed to the ignition device.

4. The signal processing device according to claim 2, wherein the signal processing device is connected to the engine control device so that the ignition signal is bifurcated, and inputted to the ignition device and the signal processing device, and the signal processing device is configured to, upon receiving the ignition signal, output the electromagnetic wave drive signal that has a rising timing and a falling timing wherein the rising timing is after the ignition signal rises and before the ignition signal falls, and the falling timing is after the ignition signal falls.

5. The signal processing device according to claim 2, wherein the signal processing device changes a pulse width of the electromagnetic wave drive signal based on a cycle of the ignition signal.

6. The signal processing device according to claim 1, wherein the engine includes a plurality of combustion chambers, the ignition devices are attached to the engine, respectively in association with the combustion chambers, the electromagnetic wave emission device includes an electromagnetic wave oscillation device, a plurality of antennae for electromagnetic wave emission respectively corresponding to the plurality of combustion chambers, and a distributor that switches the antenna to be supplied with the electromagnetic wave oscillated by the electromagnetic wave oscillation device, and while the engine control device outputs the ignition signal for each ignition device corresponding to each combustion chamber, the signal processing device is configured to, upon receiving the ignition signal, output to the distributor a distribution signal for switching a supply destination of the electromagnetic wave to the antenna of the combustion chamber corresponding to the ignition device to which the ignition signal is directed.

7. The signal processing device according to claim 3, wherein the signal processing device changes a pulse width of the electromagnetic wave drive signal based on a cycle of the ignition signal.

8. The signal processing device according to claim 4, wherein the signal processing device changes a pulse width of the electromagnetic wave drive signal based on a cycle of the ignition signal.

9. The signal processing device according to claim 2, wherein the engine includes a plurality of combustion chambers, the ignition devices are attached to the engine, respectively in association with the combustion chambers, the electromagnetic wave emission device includes an electromagnetic wave oscillation device, a plurality of antennae for electromagnetic wave emission respectively corresponding to the plurality of combustion chambers, and a distributor that switches the antenna to be supplied with the electromagnetic wave oscillated by the electromagnetic wave oscillation device, and while the engine control device outputs the ignition signal for each ignition device corresponding to each combustion chamber, the signal processing device is configured to, upon receiving the ignition signal, output to the distributor a distribution signal for switching a supply destination of the electromagnetic wave to the antenna of the combustion chamber corresponding to the ignition device to which the ignition signal is directed.

10. The signal processing device according to claim 3, wherein the engine includes a plurality of combustion chambers, the ignition devices are attached to the engine, respectively in association with the combustion chambers, the electromagnetic wave emission device includes an electromagnetic wave oscillation device, a plurality of antennae for electromagnetic wave emission respectively corresponding to the plurality of combustion chambers, and a distributor that switches the antenna to be supplied with the electromagnetic wave oscillated by the electromagnetic wave oscillation device, and while the engine control device outputs the ignition signal for each ignition device corresponding to each combustion chamber, the signal processing device is configured to, upon receiving the ignition signal, output to the distributor a distribution signal for switching a supply destination of the electromagnetic wave to the antenna of the combustion chamber corresponding to the ignition device to which the ignition signal is directed.

11. The signal processing device according to claim 4, wherein the engine includes a plurality of combustion chambers, the ignition devices are attached to the engine, respectively in association with the combustion chambers, the electromagnetic wave emission device includes an electromagnetic wave oscillation device, a plurality of antennae for electromagnetic wave emission respectively corresponding to the plurality of combustion chambers, and a distributor that switches the antenna to be supplied with the electromagnetic wave oscillated by the electromagnetic wave oscillation device, and while the engine control device outputs the ignition signal for each ignition device corresponding to each combustion chamber, the signal processing device is configured to, upon receiving the ignition signal, output to the distributor a distribution signal for switching a supply destination of the electromagnetic wave to the antenna of the combustion chamber corresponding to the ignition device to which the ignition signal is directed.

12. The signal processing device according to claim 5, wherein the engine includes a plurality of combustion chambers, the ignition devices are attached to the engine, respectively in association with the combustion chambers, the electromagnetic wave emission device includes an electromagnetic wave oscillation device, a plurality of antennae for electromagnetic wave emission respectively corresponding to the plurality of combustion chambers, and a distributor that switches the antenna to be supplied with the electromagnetic wave oscillated by the electromagnetic wave oscillation device, and while the engine control device outputs the ignition signal for each ignition device corresponding to each combustion chamber, the signal processing device is configured to, upon receiving the ignition signal, output to the distributor a distribution signal for switching a supply destination of the electromagnetic wave to the antenna of the combustion chamber corresponding to the ignition device to which the ignition signal is directed.

* * * * *